US005348930A

United States Patent [19]

Kobayashi et al.

[11] Patent Number: 5,348,930

[45] Date of Patent: Sep. 20, 1994

[54] HEAT SENSITIVE RECORDING MATERIAL

[75] Inventors: Norio Kobayashi; Toshiaki Takahashi; Masahiro Makino, all of Sabae; Masaaki Hosoda, Hukui, all of Japan

[73] Assignee: Nicca Chemical Co., Ltd., Hukui, Japan

[21] Appl. No.: 42,109

[22] Filed: Apr. 2, 1993

[51] Int. Cl.[5] ..... B41M 5/035; B41M 5/38

[52] U.S. Cl. ..... 503/209; 503/216; 503/225

[58] Field of Search ..... 427/150, 151; 503/208, 503/209, 216, 225

[56] References Cited

U.S. PATENT DOCUMENTS

| | | | |
|---|---|---|---|
| 4,853,362 | 8/1989 | Satake et al. | 503/209 |
| 4,868,151 | 9/1989 | Satake et al. | 503/209 |

FOREIGN PATENT DOCUMENTS

| | | | |
|---|---|---|---|
| 251209 | 1/1988 | European Pat. Off. | 503/216 |
| 307836 | 3/1989 | European Pat. Off. | 503/216 |
| 361232 | 4/1990 | European Pat. Off. | 503/209 |
| 466096 | 1/1992 | European Pat. Off. | 503/216 |
| 55-32084 | 3/1980 | Japan | 503/216 |

OTHER PUBLICATIONS

Patent Abstracts of Japan, JP58205793, Nov. 1983.
Patent Abstracts of Japan, JP4103386, Jul. 1992.
Patent Abstracts of Japan, JP4214389, Mar. 1992.
Derwent Abstract 93/112522, Mar. 1993.
Derwent Abstract 93-162044, Mar. 1993.
Derwent Abstract 88-046314, Jan. 1988.
Derwent Abstract of JP 63-003991.

*Primary Examiner*—B. Hamilton Hess
*Attorney, Agent, or Firm*—Millen, White, Zelano & Branigan

[57] ABSTRACT

A heat sensitive recording material comprises a heat sensitive color forming layer containing a color former of a colorless or light color leuco dyestuff, a developer which develops color by reaction with the color former upon heating and is a mixture of 97 to 70 weight % of 2,4'-dihydroxydiphenylsulfone and 3 to 30 weight % of 4,4'-dihydroxydiphenylsulfone and a sensitizer. The heat sensitive color forming layer is coated on a support. The heat sensitive recording material has excellent color forming property by which sufficiently high concentration and sensitivity of the color forming are obtained and has excellent stability of the image with time.

10 Claims, No Drawings

HEAT SENSITIVE RECORDING MATERIAL

BACKGROUND OF THE INVENTION

1. Field of the Invention

The present invention relates to a novel heat sensitive recording material. More particularly, it relates to a heat sensitive recording material with enhanced color forming and image stability.

2. Description of the Prior Art

Heat sensitive recording materials having a heat sensitive layer which forms color by heating and is coated on a support, such as paper, synthetic paper and plastic film, are widely used in thermal printers of facsimiles, portable calculators, microcomputers and the like, in thermo-pen recorders of cardiograph and analytical instruments, in train tickets, in labels for POS at super markets and the like applications.

The heat sensitive recording materials are generally produced by the following processes: a color former of a colorless or light color leuco dyestuff, such as lactone dyestuffs, lactam dyestuffs and spiropyran dyestuffs, and a developer which develops color by reaction with the color former by heating are dispersed in a disperse medium separately after each of the components have been pulverized with a ball mill or a sand mill; these dispersions are mixed with addition of a binder to form a single dispersion; a coating dispersion is prepared from this dispersion, when necessary, with addition of a wax, a sensitizer, a surface active agent, a defoaming agent, an inorganic pigment and the like; and the coating dispersion is coated on a support such as paper and dried to form the heat sensitive color forming layer.

As a developer having good image stability, 2,4'-dihydroxydiphenylsulfone and 4,4'-dihydroxydiphenylsulfone are used in Laid Open Japanese Patent Applications 1981-127486 and 1988-3991. However, these compounds show inferior heat response and satisfactory concentration of the color forming cannot be obtained. To overcome the problem, a sensitizer is generally added to the developer to decrease the temperature required for the color developing. As the sensitizer for this purpose, paraffin wax, amides such as fatty acid amides, esters such as dimethyl terephthalate and ethers are generally used. However, these sensitizers do not have sufficient ability with respect to the concentration and the sensitivity of the color forming and are not satisfactory because of the problem that in, age stability is inferior even when an image of high concentration of the color forming is obtained and the image deteriorate with the passage of time.

SUMMARY OF THE INVENTION

The present invention accordingly has an object to overcome the problems of the conventional heat sensitive recording materials described above and to provide a heat sensitive recording material having excellent color forming property by which sufficiently high concentration and sensitivity of the color forming are obtained and having excellent stability of the image with time (weatherability).

Extensive investigations undertaken by the present inventors with the object described above lead to a discovery that, when 2,4'-dihydroxydiphenylsulfone and 4,4'-dihydroxydiphenylsulfone are used as the developer in the form of a mixture in a specific ratio, the object can be achieved by taking advantage of the fact that the melting point of the developer and the temperature difference between the start and the end of melting are decreased. It was also discovered that a specific sensitizer contained in the heat sensitive color forming layer is effective for achieving the object. The present invention has been completed on the basis of the discovery.

Thus the present invention provides a heat sensitive recording material comprising a heat sensitive color forming layer containing a color former of a colorless or light color leuco dyestuff, a developer which develops color by reaction with the color former upon heating and is a mixture of 97 to 70 weight % of 2,4'-dihydroxydiphenylsulfone and 3 to 30 weight % of 4,4'-dihydroxydiphenylsulfone and a sensitizer, the heat sensitive color forming layer being coated on a support.

Other and further objects, features and advantages of the invention will appear more fully from the following description.

DETAILED DESCRIPTION OF THE INVENTION

It is essential in the present invention that the heat sensitive recording material comprises a heat sensitive color forming layer containing a color former, a developer which is a mixture of 2,4'-dihydroxydiphenylsulfone and 4,4'-dihydroxydiphenylsulfone (m.p. 248 -9° C.) and a specific sensitizer.

The amount of 4,4'-dihydroxydiphenylsulfone mixed with 2,4'-dihydroxydiphenylsulfone is preferably 3 to 30 weight % and more preferably 3 to 10 weight % based on the total amount of the developer. When the amount is less than 3 weight %, the heat response of the color forming is inferior even though the in, age stability is good. When the amount is more than 30 weight %, the temperature difference between the start and the end of melting and the diffusion to texture are increased and the effect of the invention is not sufficiently exhibited.

When the melting point alone is to be optimized, the amount of 4,4'-dihydroxydiphenylsulfone is preferably in the range from 20 to 25 weight %. However, a lower amount of this compound is desirable for better image stability. When these two factors are taken into consideration simultaneously to make a good balance between them, the more preferable amount of 4,4'-dihydroxydiphenylsulfone is 3 to 10 weight % as described above.

For preparation of the heat sensitive color former of the invention. 4,4'-dihydroxydiphenylsulfone may be mixed with 2,4'-dihydroxydiphenylsulfone when the dispersion is prepared or before the dispersion is prepared.

The component compounds of the developer of the invention, 2,4'-dihydroxydiphenylsulfone and 4,4'-dihydroxydiphenylsulfone, can be mixed by various methods. For example, a mixture containing the component compounds of suitable purities can be prepared when the component con, pounds are synthesized and purified. The component compounds can also be mixed after they are purified. When the component compounds are mixed after purification, they are preferably mixed in the form of solutions followed by removal of the disperse medium. However, they may be mixed in the form of powders by using a mixer, such as a sand grind mill. Dispersions of the component compounds may be prepared separately and mixed in a suitable ratio.

The kind of the colorless or light color leuco dyestuff utilized as the color former in the heat sensitive color forming layer of the invention is not particularly limited but a suitable compound can be selected and utilized from the compounds generally utilized as a color former in conventional heat sensitive recording materials. Examples of the leuco dyestuff are crystal violet lactone, malachite green lactone, 3,3-bis-(p-dimethylaminophenyl)-6-aminophthalide, 3,3-bis-(p-dimethylaminophenyl)-6-(p-toluenesulfonamide)phthalide, 3-dimethylamino-6-methyl-7-chlorofluorane, 3-diethylamino-7-chlorofluorane, 3-diethylamino-7-(o-chloroanilino)fluorane, 3-diethylamino-7-(m-trifluoromethylanilino)-fluorane, 3-diethylamino-7-phenylfluorane, 3-diethylamino-7-dibenzylaminoflurane, 3-diethylamino-5-methyl-7-dibenzylaminoflurane, 3-diethylamino-6-methyl-7-(o,p-dimethylanilino)fluorane, 3-diethylamino-7-(o-fluoroanilino)fluorane, 3-diethylamino-6-methyl-7-chlorofluorane, 3-diethylamino-6-methylfluorane, 3-diethylaminobenzo[a]fluorane, 3-dibutylamino-7-(o-chloroanilino)fluorane, 3-dibutylamino-6-methyl-7-anilinofluorane, 3-dibutylamino-7-fluoroanilinofluorane, 3-(N-methyl-N-propylamino)-6-methyl-7-anilinofluorane, 3-(N-ethyl-N-isobutylamino)-6-methyl-7-anilinofluorane, 3-cyclohexylamino-6-chlorofluorane, 3-pyrrolidino-6-methyl-7-anilinofluorane, 3-piperidino-6-methyl-7-anilinofluorane, 3-(n-ethyl-N-isoamylamino)-6-methyl-7-anilinofluorane, 3-(N-methyl-N-cyclohexylamino)-6-methyl-7-anilinofluorane, 2-(N-methyl-N-phenylamino)-6-(N-ethyl-N-p-toluidinoamino)fluorane, 3-(N-ethyl-N-p-toluidinoamino)-6-methyl-7-anilinofluorane, 3-(N-ethyl-N-tetrahydrofurfurylamino)-6-methyl-7-anilinofluorane, 1,3,3-trimethyl-6'-chloro-8'-methoxyindolinobenzospiropyran and the like compounds. However, the leuco dyestuff utilized in the heat sensitive color forming layer of the invention is not limited to these compounds. One or a combination of two or more leuco dyestuffs may be used and the amount thereof is suitably selected according to the developer utilized therewith.

It is essential that the heat sensitive color forming layer of the invention contains at least one sensitizer selected from the group consisting of p-benzyldiphenyl, di(p-methylbenzyl)oxalate, β-benzyloxynaphthalene, 1,2-di(m-methylphenoxy)ethane, m-terphenyl, diphenylsulfone and phenyl 2,4,6-mesitylenesulfonate in combination with the color former and the developer. The specific amount thereof is not critical and can range from about 10 to 700, parts, preferably 30 to 350, weight parts based on 100 weight parts of the color former (dyestuff).

Sensitizers other than the compounds described above may be utilized in combination with the compounds described above according to necessity within the range that the object of the invention is not adversely affected. Examples of the other sensitizers are fatty acid amides, such as stearic acid amide, stearic acid methylol amide, oleic acid amide, palmitic acid amide, coconut fatty acid amide and the like, ethers, such as 1,2-bisphenoxyethane, 1,2-bisphenoxymethylbenzene, 1,2-bistolyloxymethylbenzene, 1,4-dimethoxynaphthalene, 1,4-dibenzyloxynaphthalene, benzyloxythiophenyl ether, 4-(p-tolyloxy)biphenyl, bisphenol S diallyl ether and the like, and esters, such as dibenzyl oxalate, dibenzyl terephthalate, phenyl 1-hydroxy-2-naphthoate, benzyl p-benzyloxybenzoate and the like.

In the heat sensitive color forming layer of the invention, an image stabilizer may be added. Examples of such image stabilizer are 4,4'-butylidene(6-t-butyl-3-methylphenol), 2,2'-di-t-butyryl-5,5'-dimethyl-4,4'-sulfonylphenol, 1,1,3-tris(2-methyl-4-hydroxy-5-cyclohexylphenyl)butane, 1,1,3-tris(2-methyl-4-hydroxy-5-t-butylphenyl)butane, 1-[4'-(4''-benzyloxyphenylsulfonyl) phenoxy]-2,3-epoxypropane and the like.

The heat sensitive color forming layer comprised in the heat sensitive recording material of the invention can be prepared by conventional methods. For example, a dispersion is prepared by dispersing the color former, the developer and the sensitizer together with a suitable binder in a medium, such as an aqueous medium and then coated on a support, followed by drying of the coated layer. Examples of the binder are hydroxyethylcellulose, methylcellulose, carboxymethylcellulose, polyvinyl alcohol, modified polyvinyl alcohols, such as carboxy modified polyvinyl alcohol, sulfonic acid modified polyvinyl alcohol, silicone modified polyvinyl alcohol, amide modified polyvinyl alcohol and the like, gelatin, casein, starch, polyacrylic acid, polyacrylic acid esters, polyvinyl acetate, acrylamide, styrene-maleic acid copolymers, styrene-butadiene copolymers, polyamide resins, petroleum resins, terpene resins and the like. The binder may be utilized singly or as a combination of two or more kinds.

Fillers may be comprised in the heat sensitive recording material of the invention. Examples of the filler are inorganic fillers, such as silica, calcium carbonate, kaolin, calcinated kaolin, diatomaceous earth, talc, titanium dioxide, aluminum hydroxide and the like, and organic fillers, such as polystyrene microballs, nylon powder, ureaformaldehyde resin fillers and the like.

Other additives may be comprised in the heat sensitive recording material of the invention. Examples of the other additives are lubricants, such as stearic acid ester wax, polyethylene wax, zinc stearate and the like, ultraviolet light absorbents, such as benzophenone absorbents like 2-hydroxy-4-benzyloxylbenzophenone and the like and triazole absorbents like 2-(2'-hydroxy-5'-methylphenyl)benzotriazole and the like, water resistance agents, such as glyoxal and the like, dispersants, defoaming agents and the like other additives.

The support utilized in the invention is not particularly limited and supports generally utilized in conventional heat sensitive recording materials, such as paper, synthetic paper, plastic film and the like, can be adopted.

To summarize the advantages obtained by the invention, the heat sensitive recording material has excellent color forming property by which sufficiently high concentration and sensitivity of the color forming are obtained and has excellent stability of the image with time.

The invention will be understood more readily with reference to the following examples; however, these examples are intended to illustrate the invention and are not to be construed to limit the scope of the invention.

The properties of the heat sensitive recording materials obtained in Examples and Comparative Examples were evaluated by the following methods.

1) Static color Forming

By using a heat inclination tester (a product of Toyo Seiki Co., Ltd.), color forming was made with a sample under the pressure of 2 kg/cm$^2$ for 5 seconds at 105° C. Concentration of the image obtained was measured by Macbeth concentration meter RD-918® (a product of Macbeth Co., Ltd.).

2) Dynamic Color Forming

By using a heat sensitive printer (a product of Okura Denki Co., Ltd., printing pressure 20 V, puls width 3 ms), color forming was made with a sample and concentration of the image obtained was measured by the Macbeth concentration meter described above.

3) Resistance against Plasticizers in Polyvinyl Chloride

The image formed by using the heat sensitive printer described above (printing pressure 20 V, puls width 3 ms) was stuck to a polyvinyl chloride sheet and left standing under the load of 50 g/cm$^2$ at 45° C. for 24 hours. After the treatment, concentration of the image was measured by the Macbeth concentration meter described above to obtain the residual concentration.

EXAMPLE 1

Dispersion A and Dispersion B described as follows were prepared separately as the components for preparation of the heat sensitive color forming layer and dispersed with each other by pulverizing finely with a sand mill for 3 hours.

| [Dispersion A] (a dispersion of a color former) | |
|---|---|
| 3-(N-methyl-N-cyclohexyl)amino-6-methyl-7-anilinofluorane | 2.0 weight parts |
| 10% aqueous solution of polyvinyl alcohol | 4.3 weight parts |
| water | 2.0 weight parts |

| [Dispersion B] (a dispersion of a developer) | |
|---|---|
| 2,4'-dihydroxydiphenylsulfone (containing 5% of 4,4'-dihydroxydiphenylsulfone) | 2.8 weight parts |
| 10% aqueous solution of polyvinyl alcohol | 12.0 weight parts |
| water | 5.2 weight parts |

Then, Dispersion D described as follows was prepared Dispersion B and Dispersion C also described in the following.

| [Dispersion C] (a dispersion of a sensitizer) | |
|---|---|
| β-benzyloxynaphthalene | 2.8 weight parts |
| 10% aqueous solution of polyvinyl alcohol | 12.0 weight parts |
| water | 5.2 weight parts |
| [Dispersion D] | |
| Dispersion B | 3.0 weight parts |
| Dispersion C | 3.0 weight parts |
| 10% aqueous solution of polyvinyl alcohol | 8.0 weight parts |
| kaolin | 0.61 weight parts |

Dispersion A (0.58 weight parts) and Dispersion D (10 weight parts) were mixed to prepare a coating material for the heat sensitive color forming layer. The coating material was coated on a high grade paper having a basis weight of 65 g/m$^2$ to form a dried coating layer of about 6 g/m$^2$. The coated paper thus prepared was dried in the air to obtain a heat sensitive recording paper. The result of evaluation of the heat sensitive recording paper is shown in Table 1.

EXAMPLE 2

A heat sensitive recording paper was prepared by the same method as in Example 1 except that 2,4'-dihydroxydiphenylsulfone containing 5% of 4,4'-dihydroxydiphenylsulfone in Dispersion B in Example 1 was replaced by 2,4'-dihydroxydiphenylsulfone containing 25% of 4,4'-dihydroxydiphenylsulfone. The result of the evaluation is shown in Table 1.

COMPARATIVE EXAMPLE 1

A heat sensitive recording paper for comparison was prepared by the same method as in Example 1 except that 2,4'-dihydroxydiphenylsulfone containing 5% of 4,4'-dihydroxydiphenylsulfone in Dispersion B in Example 1 was replaced by 4,4'-dihydroxydiphenylsulfone. The result of the evaluation is shown in Table 1.

COMPARATIVE EXAMPLE 2

A heat sensitive recording paper for comparison was prepared by the same method as in Example 1 except that 2,4'-dihydroxydiphenylsulfone containing 5% of 4,4'-dihydroxydiphenylsulfone in Dispersion B in Example 1 was replaced by 2,2-bis(4'-hydroxyphenyl)propane. The result of the evaluation is shown in Table 1.

TABLE 1

| | | Sensitizer: β-benzyloxynaphthalene | | | |
|---|---|---|---|---|---|
| | developer | content of 4,4'-dihydroxydiphenylsulfone | concn. of color forming static | concn. of color forming dynamic | resistance against PVC plasticizer |
| Example 1 | 2,4'-dihydroxydiphenylsulfone | 5 | 1.04 | 1.07 | 101 |
| Example 2 | 2,4'-dihydroxydiphenylsulfone | 25 | 1.15 | 1.11 | 90 |
| Comparative Example 1 | 4,4'-dihydroxydiphenylsulfone | — | 0.34 | 0.73 | 96 |
| Comparative Example 2 | 2,2-bis(4'-hydroxyphenyl)propane | — | 1.21 | 1.13 | 27 |

EXAMPLE 3

A heat sensitive recording paper was prepared by the same method as in Example 1 except that β-benzyloxynaphthalene in Dispersion C in Example 1 was replaced by di(p-methylbenzyl) oxalate. The result of the evaluation is shown in Table 2.

EXAMPLE 4

A heat sensitive recording paper was prepared by the same method as in Example 3 except that 2,4'-dihydroxydiphenylsulfone containing 5% of 4,4'-dihydroxydiphenylsulfone in Dispersion B in Example 3 was replaced by 2,4'-dihydroxydiphenylsulfone containing 25% of 4,4'-dihydroxydiphenylsulfone. The result of the evaluation is shown in Table 2.

COMPARATIVE EXAMPLE 3

A heat sensitive recording paper for comparison was prepared by the same method as in Example 3 except that 2,4'-dihydroxydiphenylsulfone containing 5% of 4,4'-dihydroxydiphenylsulfone in Dispersion B in Example 3 was replaced by 4,4'-dihydroxydiphenylsulfone. The result of the evaluation is shown in Table 2.

COMPARATIVE EXAMPLE 4

A heat sensitive recording paper for comparison was prepared by the same method as in Example 3 except that 2,4'-dihydroxydiphenylsulfone containing 5% of 4,4'-dihydroxydiphenylsulfone in Dispersion B in Example 3 was replaced by 2,2-bis(4'-hydroxyphenyl)propane. The result of the evaluation is shown in Table 2.

TABLE 2

| | Sensitizer: di(p-methylbenzyl) oxalate | | | | |
|---|---|---|---|---|---|
| | developer | content of 4,4'-dihydroxydiphenylsulfone | concn. of color forming static | concn. of color forming dynamic | resistance against PVC plasticizer |
| Example 3 | 2,4'-dihydroxydiphenylsulfone | 5 | 1.02 | 1.02 | 94 |
| Example 4 | 2,4'-dihydroxydiphenylsulfone | 25 | 1.11 | 1.13 | 92 |
| Comparative Example 3 | 4,4'-dihydroxydiphenylsulfone | — | 0.47 | 0.94 | 96 |
| Comparative Example 4 | 2,2-bis(4'-hydroxyphenyl)propane | — | 1.18 | 1.06 | 26 |

EXAMPLE 5

A heat sensitive recording paper was prepared by the same method as in Example 1 except that β-benzyloxynaphthalene in Dispersion C in Example 1 was replaced by 1,2-di(m-methylphenoxy)ethane. The result of the evaluation is shown in Table 3.

EXAMPLE 6

A heat sensitive recording paper was prepared by the same method as in Example 5 except that 2,4'-dihydroxydiphenylsulfone containing 5% of 4,4'-dihydroxydiphenylsulfone in Dispersion B in Example 5 was replaced by 2,4'-dihydroxydiphenylsulfone containing 25% of 4,4'-dihydroxydiphenylsulfone. The result of the evaluation is shown in Table 3.

COMPARATIVE EXAMPLE 5

A heat sensitive recording paper for comparison was prepared by the same method as in Example 5 except that 2,4'-dihydroxydiphenylsulfone containing 5% of 4,4'-dihydroxydiphenylsulfone in Dispersion B in Example 5 was replaced by 4,4'-dihydroxydiphenylsulfone. The result of the evaluation is shown in Table 3.

COMPARATIVE EXAMPLE 6

A heat sensitive recording paper for comparison was prepared by the same method as in Example 5 except that 2,4'-dihydroxydiphenylsulfone containing 5% of 4,4'-dihydroxydiphenylsulfone in Dispersion B in Example 5 was replaced by 2,2-bis(4'-hydroxyphenyl)propane. The results of evaluation is shown in Table 3.

TABLE 3

| | Sensitizer: di(m-methylphenoxy)ethane | | | | |
|---|---|---|---|---|---|
| | developer | content of 4,4'-dihydroxydiphenylsulfone | concn. of color forming static | concn. of color forming dynamic | resistance against PVC plasticizer |
| Example 5 | 2,4'-dihydroxydiphenylsulfone | 5 | 1.00 | 1.12 | 93 |
| Example 6 | 2,4'-dihydroxydiphenylsulfone | 25 | 1.05 | 1.12 | 89 |
| Comparative Example 5 | 4,4'-dihydroxydiphenylsulfone | — | 0.34 | 0.71 | 98 |
| Comparative Example 6 | 2,2-bis(4'-hydroxyphenyl)propane | — | 1.26 | 1.12 | 29 |

EXAMPLE 7

A heat sensitive recording paper was prepared by the same method as in Example 1 except that β-benzyloxynaphthalene in Dispersion C in Example 1 was replaced by p-benzylbiphenyl. The result of the evaluation is shown in Table 4.

EXAMPLE 8

A heat sensitive recording paper was prepared by the same method as in Example 7 except that 2,4'-dihydroxydiphenylsulfone containing 5% of 4,4'-dihydroxydiphenylsulfone in Dispersion B in Example 7 was replaced by 2,4'-dihydroxydiphenylsulfone containing 25% of 4,4'-dihydroxydiphenylsulfone. The result of the evaluation is shown in Table 4.

COMPARATIVE EXAMPLE 7

A heat sensitive recording paper for comparison was prepared by the same method as in Example 7 except that 2,4'-dihydroxydiphenylsulfone containing 5% of 4,4'-dihydroxydiphenylsulfone in Dispersion B in Example 7 was replaced by 4,4'-dihydroxydiphenylsulfone. The result of the evaluation is shown in Table 4.

COMPARATIVE EXAMPLE 8

A heat sensitive recording paper for comparison was prepared by the same method as in Example 7 except that 2,4'-dihydroxydiphenylsulfone containing 5% of 4,4'-dihydroxydiphenylsulfone in Dispersion B in Example 7 was replaced by 2,2-bis(4'-hydroxyphenyl)propane. The results of evaluation is shown in Table 4.

TABLE 4

| | developer | Sensitizer: p-benzylbiphenyl content of 4,4'-dihydroxydiphenylsulfone | concn. of color forming static | concn. of color forming dynamic | resistance against PVC plasticizer |
|---|---|---|---|---|---|
| Example 7 | 2,4'-dihydroxydiphenylsulfone | 5 | 1.02 | 1.09 | 91 |
| Example 8 | 2,4'-dihydroxydiphenylsulfone | 25 | 1.10 | 1.11 | 89 |
| Comparative Example 7 | 4,4'-dihydroxydiphenylsulfone | — | 0.51 | 0.85 | 97 |
| Comparative Example 8 | 2,2-bis(4'-hydroxyphenyl)propane | — | 1.26 | 1.15 | 35 |

EXAMPLE 9

A heat sensitive recording paper was prepared by the same method as in Example 1 except that β-benzyloxynaphthalene in Dispersion C in Example 1 was replaced by m-terphenyl. The result of the evaluation is shown in Table 5.

EXAMPLE 10

A heat sensitive recording paper was prepared by the same method as in Example 9 except that 2,4'-dihydroxydiphenylsulfone containing 5% of 4,4'-dihydroxydiphenylsulfone in Dispersion B in Example 9 was replaced by 2,4'-dihydroxydiphenylsulfone containing 25% of 4,4'-dihydroxydiphenylsulfone. The result of the evaluation is shown in Table 5.

COMPARATIVE EXAMPLE 9

A heat sensitive recording paper for comparison was prepared by the same method as in Example 9 except that 2,4'-dihydroxydiphenylsulfone containing 5% of 4,4'-dihydroxydiphenylsulfone in Dispersion B in Example 9 was replaced by 4,4'-dihydroxydiphenylsulfone. The result of the evaluation is shown in Table 5.

COMPARATIVE EXAMPLE 10

A heat sensitive recording paper for comparison was prepared by the same method as in Example 9 except that 2,4'-dihydroxydiphenylsulfone containing 5% of 4,4'-dihydroxydiphenylsulfone in Dispersion B in Example 9 was replaced by 2,2-bis(4'-hydroxyphenyl)propane. The results of evaluation is shown in Table 5.

EXAMPLE 11

A heat sensitive recording paper was prepared by the same method as in Example 1 except that β-benzyloxynaphthalene in Dispersion C in Example 1 was replaced by diphenylsulfone. The result of the evaluation is shown in Table 6.

EXAMPLE 12

A heat sensitive recording paper was prepared by the same method as in Example 11 except that 2,4'-dihydroxydiphenylsulfone containing 5% of 4,4'-dihydroxydiphenylsulfone in Dispersion B in Example 11 was replaced by 2,4'-dihydroxydiphenylsulfone containing 25% of 4,4'-dihydroxydiphenylsulfone. The result of the evaluation is shown in Table 6.

COMPARATIVE EXAMPLE 11

A heat sensitive recording paper for comparison was prepared by the same method as in Example 11 except that 2,4'-dihydroxydiphenylsulfone containing 5% of 4,4'-dihydroxydiphenylsulfone in Dispersion B in Example 11 was replaced by 4,4'-dihydroxydiphenylsulfone. The result of the evaluation is shown in Table 3.

COMPARATIVE EXAMPLE 12

A heat sensitive recording paper for comparison was prepared by the same method as in Example 11 except that 2,4'-dihydroxydiphenylsulfone containing 5% of 4,4'-dihydroxydiphenylsulfone in Dispersion B in Example 11 was replaced by 2,2-bis(4'-hydroxyphenyl)propane. The results of evaluation is shown in Table 6.

TABLE 5

| | developer | Sensitizer: m-terphenyl content of 4,4'-dihydroxydiphenylsulfone | concn. of color forming static | concn. of color forming dynamic | resistance against PVC plasticizer |
|---|---|---|---|---|---|
| Example 9 | 2,4'-dihydroxydiphenylsulfone | 5 | 1.01 | 1.06 | 93 |
| Example 10 | 2,4'-dihydroxydiphenylsulfone | 25 | 1.14 | 1.15 | 88 |
| Comparative Example 9 | 4,4'-dihydroxydiphenylsulfone | — | 0.48 | 0.91 | 96 |
| Comparative Example 10 | 2,2-bis(4'-hydroxyphenyl)propane | — | 1.20 | 1.16 | 31 |

TABLE 6

| | developer | Sensitizer: diphenylsulfone content of 4,4'-dihydroxydiphenylsulfone | concn. of color forming static | concn. of color forming dynamic | resistance against PVC plasticizer |
|---|---|---|---|---|---|
| Example 11 | 2,4'-dihydroxydiphenylsulfone | 5 | 1.15 | 1.05 | 92 |

TABLE 6-continued

| | developer | Sensitizer: diphenylsulfone content of 4,4'-dihydroxydiphenylsulfone | concn. of color forming static | concn. of color forming dynamic | resistance against PVC plasticizer |
|---|---|---|---|---|---|
| Example 12 | 2,4'-dihydroxydiphenylsulfone | 25 | 1.13 | 1.08 | 90 |
| Comparative Example 11 | 4,4'-dihydroxydiphenylsulfone | — | 0.76 | 1.10 | 97 |
| Comparative Example 12 | 2,2-bis(4'-hydroxyphenyl)propane | — | 1.05 | 1.04 | 23 |

EXAMPLE 13

A heat sensitive recording paper was prepared by the same method as in Example 1 except that β-benzyloxynaphthalene in Dispersion C in Example 1 was replaced by phenyl 2,4,6-mesitylenesulfonate. The result of the evaluation is shown in Table 7.

EXAMPLE 14

A heat sensitive recording paper was prepared by the same method as in Example 13 except that 2,4'-dihydroxydiphenylsulfone containing 5% of 4,4'-dihydroxydiphenylsulfone in Dispersion B in Example 13 was replaced by 2,4'-dihydroxydiphenylsulfone containing 25% of 4,4'-dihydroxydiphenylsulfone. The result of the evaluation is shown in Table 7.

COMPARATIVE EXAMPLE 13

A heat sensitive recording paper for comparison was prepared by the same method as in Example 13 except that 2,4'-dihydroxydiphenylsulfone containing 5% of 4,4'-dihydroxydiphenylsulfone in Dispersion B in Example 13 was replaced by 4,4'-dihydroxydiphenylsulfone. The result of the evaluation is shown in Table 7.

COMPARATIVE EXAMPLE 14

A heat sensitive recording paper for comparison was prepared by the same method as in Example 13 except that 2,4'-dihydroxydiphenylsulfone containing 5% of 4,4'-dihydroxydiphenylsulfone in Dispersion B in Example 13 was replaced by 2,2-bis(4'-hydroxyphenyl)propane. The results of evaluation is shown in Table 7.

TABLE 7

| | developer | Sensitizer: phenyl 2,4,6-mesitylenesulfonate content of 4,4'-dihydroxydiphenylsulfone | concn. of color forming static | concn. of color forming dynamic | resistance against PVC plasticizer |
|---|---|---|---|---|---|
| Example 13 | 2,4'-dihydroxydiphenylsulfone | 5 | 1.00 | 1.05 | 94 |
| Example 14 | 2,4'-dihydroxydiphenylsulfone | 25 | 1.07 | 1.10 | 89 |
| Comparative Example 13 | 4,4'-dihydroxydiphenylsulfone | — | 0.68 | 0.98 | 98 |
| Comparative Example 14 | 2,2-bis(4'-hydroxyphenyl)propane | — | 1.10 | 1.05 | 29 |

While the invention has been particularly shown and described with reference to preferred embodiments thereof, it will be understood by those skilled in the art that the foregoing and other changes in form and details can be made therein without departing from the spirit and scope of the invention.

What is claimed is:

1. A heat sensitive recording material comprising, as a coating on a support, a heat sensitive color forming layer containing a color former of colorless or light color leuco dyestuff, a developer which develops color by reaction with the color former upon heating and is a mixture of 97–70% by weight of 2,4'-dihydroxydiphenylsulfone and 3–30% by weight of 4,4'-dihydroxydiphenylsulfone and at least one sensitizer selected from the group consisting of p-benzyldiphenyl, di(p-methylbenzyl) oxalate, β-benzyl-oxynaphthalene, 1,2-di(methylphenoxy)ethane, m-terphenyl, diphenylsulfone and phenyl 2,4,6-mesitylenesulfonate.

2. The heat sensitive recording material of claim 1, wherein the developer is a mixture of 97 to 90 weight % of 2,4'-dihydroxydiphenylsulfone and 3 to 10 weight % of 4,4'-dihydroxydiphenylsulfone.

3. The heat sensitive recording material of claim 1 wherein the sensitizer is p-benzyldiphenyl.

4. The heat sensitive recording material of claim 1 wherein the sensitizer is di(p-methylbenzyl) oxalate.

5. The heat sensitive recording material of claim 1 wherein the sensitizer is β-benzyloxynaphthalene.

6. The heat sensitive recording material of claim 1 wherein the sensitizer is 1,2-di(m-methylphenoxy)ethane.

7. The heat sensitive recording material of claim 1 wherein the sensitizer is m-terphenyl.

8. The heat sensitive recording material of claim 1 wherein the sensitizer is diphenylsulfone.

9. The heat sensitive recording material of claim 1 wherein the sensitizer is phenyl 2,4,6-mesitylenesulfonate.

10. The heat sensitive recording material of claim 1, wherein the sensitizer is present in an amount of 10–700 parts by weight based on 100 parts by weight of the color former.

* * * * *